US005201273A

United States Patent [19]

Rosemann et al.

[11] Patent Number: 5,201,273

[45] Date of Patent: Apr. 13, 1993

[54] TOP-FEED SEWING MACHINE WITH PRESSER DEVICE

[75] Inventors: Michael Rosemann, Herford; Kurt Biermann, Bielefeld, both of Fed. Rep. of Germany

[73] Assignee: Dürkopp Adler Aktiengesellschaft, Fed. Rep. of Germany

[21] Appl. No.: 763,948

[22] Filed: Sep. 23, 1991

[30] Foreign Application Priority Data

Sep. 25, 1990 [DE] Fed. Rep. of Germany ..... 4030269

[51] Int. Cl.[5] ..... D05B 27/00

[52] U.S. Cl. ..... 112/311; 112/313; 112/320; 112/235

[58] Field of Search ..... 112/311, 303, 320, 312, 112/313, 132, 133, 134, 144, 235

[56] References Cited

U.S. PATENT DOCUMENTS

| | | | |
|---|---|---|---|
| 3,828,704 | 8/1974 | Von Hagen et al. | 112/320 |
| 3,935,826 | 2/1976 | Nicolay et al. | 112/212 |
| 4,116,145 | 9/1978 | Nicolay | 112/212 |
| 4,422,398 | 12/1983 | Dusch | 112/320 |
| 4,446,803 | 5/1984 | Nicolay et al. | 112/320 |
| 4,724,783 | 2/1988 | Morimito | 112/320 X |

FOREIGN PATENT DOCUMENTS 8433111 2/1985 Fed. Rep. of Germany .

*Primary Examiner*—Clifford D. Crowder
*Assistant Examiner*—Paul C. Lewis
*Attorney, Agent, or Firm*—Ostrolenk, Faber, Gerb & Soffen

[57] ABSTRACT

The presser device includes a feeder foot, a holding foot and a link transmission provided between the two feet, the two feet cooperate alternately. The feeder foot has a spur which cooperates temporarily with a mating surface on the cloth feeder. During the feed phase, the spur is obliquely inclined and does not press against the material being sewn, and therefore permits dependable ruffling of an upper layer of sewing material with respect to a lower layer of sewing material. At the start and at the end of the feed phase, the spur is vertically directed and presses against the sewing material, and thus smooth tension-ruffle-free sewing together, particularly of thin material, is made possible.

24 Claims, 4 Drawing Sheets

TOP-FEED SEWING MACHINE WITH PRESSER DEVICE

BACKGROUND OF THE INVENTION

1. Field of the Invention

The present invention relates to a top-feed sewing machine with an improved presser device.

2. Background Art

A presser device of interest is disclosed in German Utility Model No. 84 33 111. The disclosures of all prior art materials mentioned herein are expressly incorporated by reference. The known presser device has, inter alia, a feeder foot which has a spur behind its two soles, as seen in the direction of feed of the material being sewn. The bottom of the spur which extends flush with the bottom of the sole rests temporarily on a web portion of the feed dog and thus makes tensionless sewing possible, particularly of thin material.

On the other hand, an intermediate plate can be placed between two layers of material to be sewn together, and between the feeder foot soles and the throat plate in the vicinity of the place of sewing, which prevents the spur from temporarily resting on the mating surface of the feed dog and on the cloth being fed. In this way, the working-in of additional width, for instance for ruffling one of the two layers of sewing material, is made possible.

The disadvantage of this known presser device is that in order to ruffle the upper layer of sewing material, the intermediate plate must be pushed between it and the lower layer of sewing material, and then, to continue the subsequent smooth sewing, if both ruffled and smooth regions are present within the path of a seem, this intermediate plate must be removed. These steps require difficult handling, which results in unproductive downtime.

If, on the other hand, in order to avoid unproductive downtime, the aforementioned intermediate plate is not inserted between the two layers of material before the ruffling is performed, then the following further disadvantage results: When ruffling the upper layer of material, only about half of the intended amount of the additional width can be worked-in, the intended amount of additional width being identical to the feed stroke of the feeder foot. The aforementioned reduced amount of additional width comes about due to the fact that, at the start of the phase of advance, the single-part feeder foot, which is fastened to a swingably suspended foot bar, engages the material being sewn, starting from the vertical and inclined obliquely forward, in the direction toward the operator. In this way, the bottom of the spur of the feeder foot, which spur is arranged behind the sewing needle, contacts the top of the upper layer of the material being sewn while the anti-skid grip side of the sole of the feeder foot has still not come into contact with the upper layer of material. Only when the foot bar, and thus the feeder foot, assumes approximately the vertical position is it possible for the gripping sole to grip the upper layer of material. Since at this time, however, the first half of the feed path has already been consumed, only the second half of the adjusted feed path can thus be suitably used for the intended ruffle formation.

SUMMARY OF THE INVENTION

Therefore, the main object of the invention is to develop a presser device that can enable ruffling to be effected, along a seam having both smooth and ruffled regions, without requiring an intermediate plate to be placed within the path of the seam, and enabling the entire preset amount of additional width to be worked-in.

A general object is to conveniently and suitably provide a presser device that can facilitate the formation of ruffling.

This object is achieved by a presser device for a top-feed sewing machine, the presser device comprising:

a feeder foot supported by a feeder bar, and a holding foot which cooperates alternately with said feeder foot and is supported by a holding bar;

the feeder foot and holding foot each having a respective sole arranged to engage material being sewn near a sewing point;

the feeder foot furthermore having a spur which presses intermittently against the material being sewn; and transmission means interconnecting the feeder foot and the holding foot, for controlling the orientation of the spur with respect to the material, said orientation being a function of the position of the holding foot.

Generally, the spur presses against the material being sewn in a substantially vertical position. The transmission means may temporarily orient the spur in an oblique position with respect to the material being sewn, said position being a function of the position of the holding foot vertically above the material. Preferably, the feeder bar is suspended so as to be movable vertically and swingable upstream and downstream with respect to a feed direction of the material being sewn, and the holding bar is suspended so as to be movable vertically.

The transmission means generally moves the spur through a range of angular positions with respect to said holding foot. The feeder foot and spur may have an intermediate position in which the sole of the feeder foot engages a top portion of said material being sewn while the spur is out of engagement with the material being sewn.

Both said feeder foot sole and said spur may engage said material being sewn in both an initial position and a final position of said feeder foot.

Preferably, in said initial position, said feeder bar is angled in a downstream direction with respect to a feed direction of said sewing material, and in said final position, said feeder bar is angled in an upstream direction with respect to said feed direction. Further, in said initial position, said feeder foot may be farther upstream with respect to said holding foot, than in said final position.

With the invention, including the embodiments disclosed herein, the following advantages are obtained:

1. Ruffle sewing work can be carried out in an efficient manner since the time expended for swinging an intermediate plate in and out is eliminated.

2. During the feed phase the obliquely inclined spur does not press against the material being sewn. Thus, with the upper and lower feeds adjusted differentially with respect to each other, dependable ruffling of the upper layer of material on the lower layer can be obtained, with full working-in of the intended additional width.

3. At the start and the end of the feed phase, the vertically directed spur presses on the material being sewn and thus, with identically adjusted upper and lower feeds, smooth tension-and ruffle-free sewing can be carried out, in particular of thin sewing material.

Further advantageous aspects and developments of the presser device are disclosed herein.

BRIEF DESCRIPTION OF THE DRAWINGS

Other objects, features and advantages of the invention will be understood from the following detailed description of two embodiments thereof, with reference to the drawings, in which.

DETAILED DESCRIPTION

Figure 1:
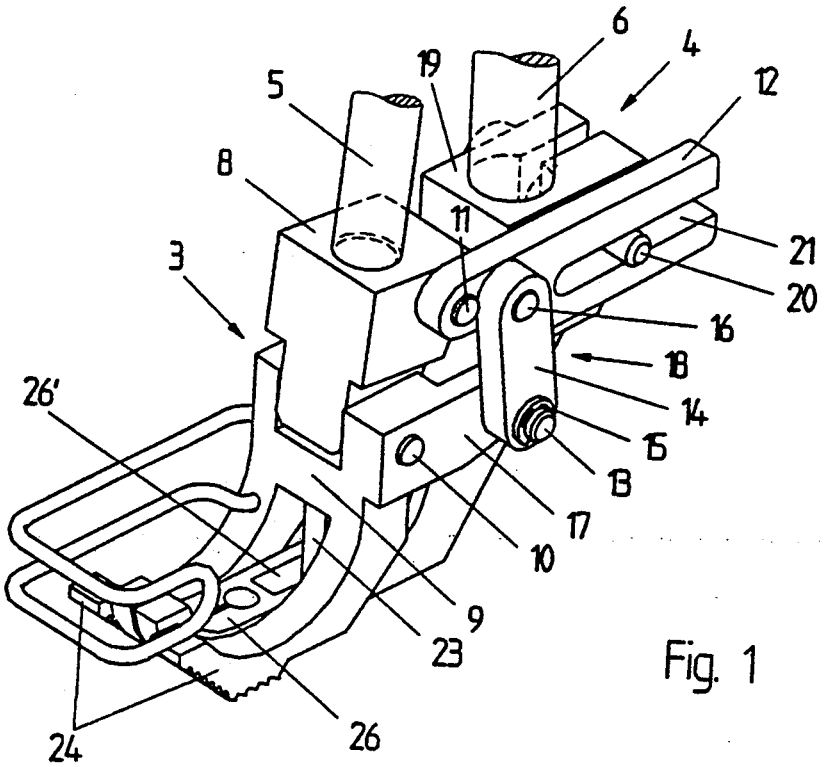
FIG. 1 is a perspective view of a presser device according to a first embodiment of the invention.
Figure 2:
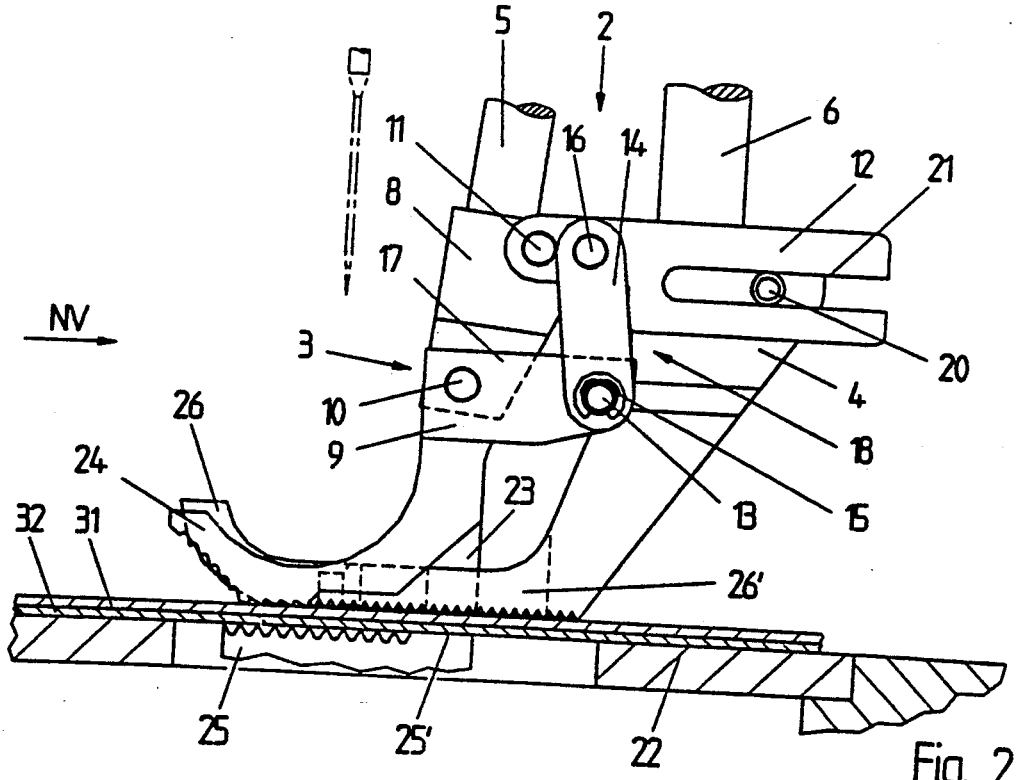
FIG. 2 is a side view of the presser device of FIG. 1.
Figure 7:
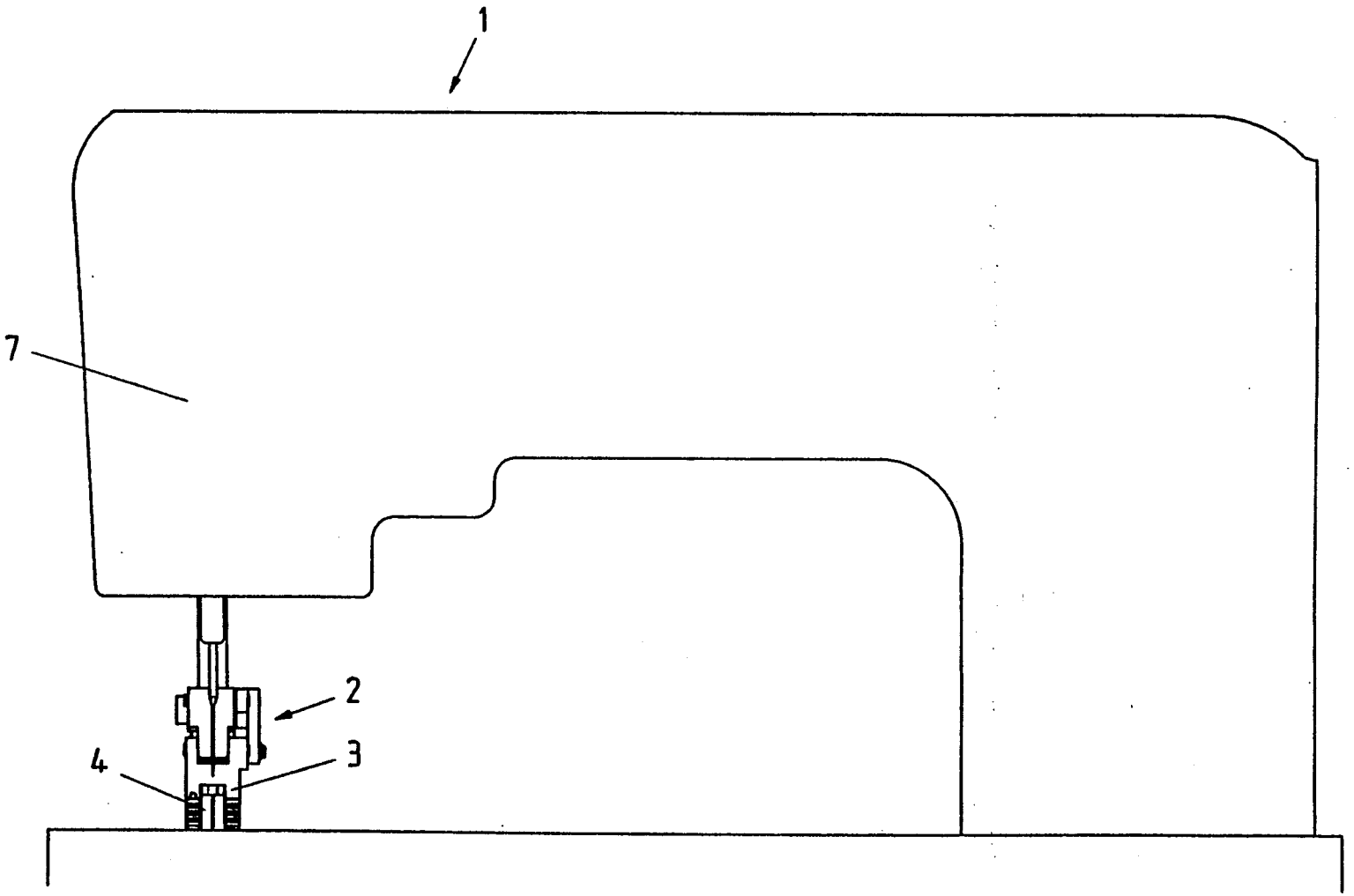
FIG. 7 is a simplified side view of a top-feed sewing machine with a presser device according to one of the disclosed embodiments of the invention.

A top-feed sewing machine 1 equipped with a presser device 2 in accordance with the invention is shown in FIG. 7. Top-feed sewing machines of interest are disclosed in U.S. Pat. Nos. 4,446,803 (German 30 43 141); 3,935,826 (German 23 37 966); and 4,116,145 (German 26 20 209). The presser device 2 has a feeder foot 3, and a holding foot 4 which cooperates alternately with the feeder foot 3. As shown in FIGS. 1 and 2, the feeder foot 3 is fastened to a feeder bar 5 and the holding foot 4 is fastened to a holding bar 6. The feeder bar 5 is mounted for vertical movement in an arm head 7 and for being swung at the same time in the material feed direction NV, by suitable suspension, and the holding bar 6 is mounted exclusively for vertical movement in the arm head 7.

The feeder foot 3 comprises a block 8 which is connected in force-locked manner to the lower part of the feeder bar 5, and a sole part 9 which is connected pivotally by a pin 10 to the block 8. A drive link 12 is swingably mounted on the block 8, as shown in FIGS. 1 and 2, by a pivot pin 11.

In the sole part 9, there is force-fitted a mounting pin 13 which receives a coupling 14. The latter is secured against unintended removal from the mounting pin 13 by an ordinary commercial securing ring 15. The other end of the coupling 14 is pivotally connected to the drive link 12 via a pin 16 which is force-fitted into the drive link 12. The upper region of the sole part 9 is structured to provide a driven link 17, as shown in FIGS. 1 and 2, the driven link 17, together with the coupling 14 and the drive link 12, forming a link transmission 18, which forms the kinematic operative connection between the feeder foot 3 and the holding foot 4. For this purpose, a guide pin 20 is provided on a block 19 which forms part of the holding foot 4, the block 19 being connected to the lower part of the holding bar 6 in force-locked manner. The protruding part of the guide pin 20 is surrounded by a slot 21. The slot 21, as shown in FIGS. 1 and 2 is located in the drive link 12.

Figure 8:
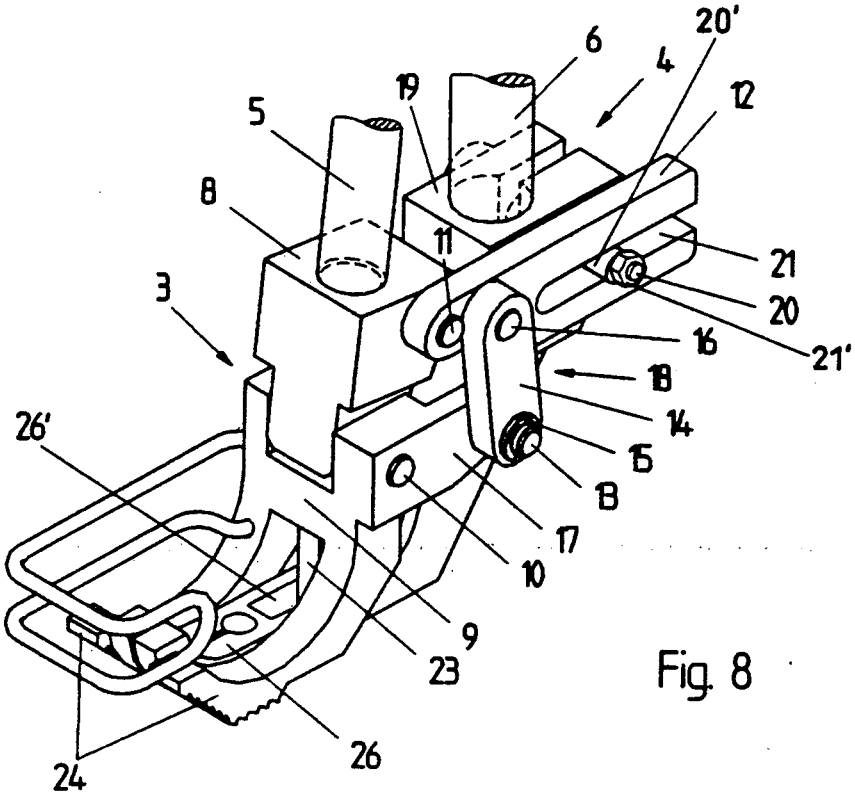
FIG. 8 is a perspective view showing a modification of the embodiment of FIGS. 1-2.
Figure 9:
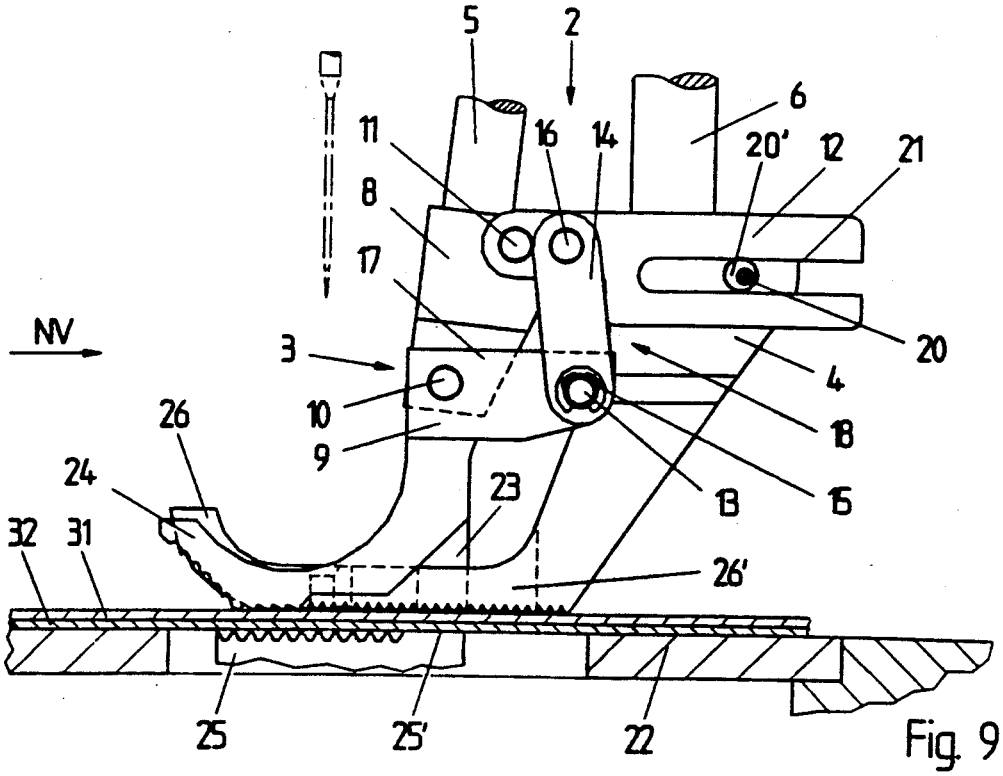
FIG. 9 is a side view of the presser device of FIG. 8.

One practical approach to compensating for manufacturing tolerances in the embodiment of FIGS. 1-2 is shown in FIGS. 8-9. A sleeve 20' having an eccentric inner bore is mounted on the guide pin 20. The slot 21 receives the sleeve 20' and is tangent to the outside diameter of the sleeve 20'. The eccentric inner bore of the sleeve 20' is supported on the guide pin 20, and secured there by a nut 21' screwed onto a threaded section of the guide pin 20 (FIG. 8). By loosening the nut 21', the sleeve 20' is adjustable relative to the guide pin 20.

On the sole part 9 there is provided a spur 23 which is directed toward a throat plate 22 and which may be similar to that disclosed in German Utility Model No. 84 33 111. In its lower position, the bottom of the spur 23 is flush with the anti-skid bottoms of two soles 24 provided on the sole part 9. The spur 23, in accordance with FIG. 2, is arranged behind the soles 24 as seen in the direction of transport NV of the sewing material, and permits tension-ruffle-free sewing, in particular of thin sewing material, in combination with a mating surface 25' provided on a cloth feeder 25.

Another sole 26, provided on the holding foot 4, has a rectangular opening 26'. As shown in FIG. 2, the spur 23 passes through the opening 26' intermittently. The sole 26 is located, as shown in FIG. 1, between the two soles 24.

According to an alternate embodiment, not shown, the feeder foot 3 may have only one sole 24, which in this case would be surrounded by two soles 26 on the holding foot 4. It is furthermore possible for the embodiments just mentioned to be used for a two-needle top-feed sewing machine 1.

Figure 6:
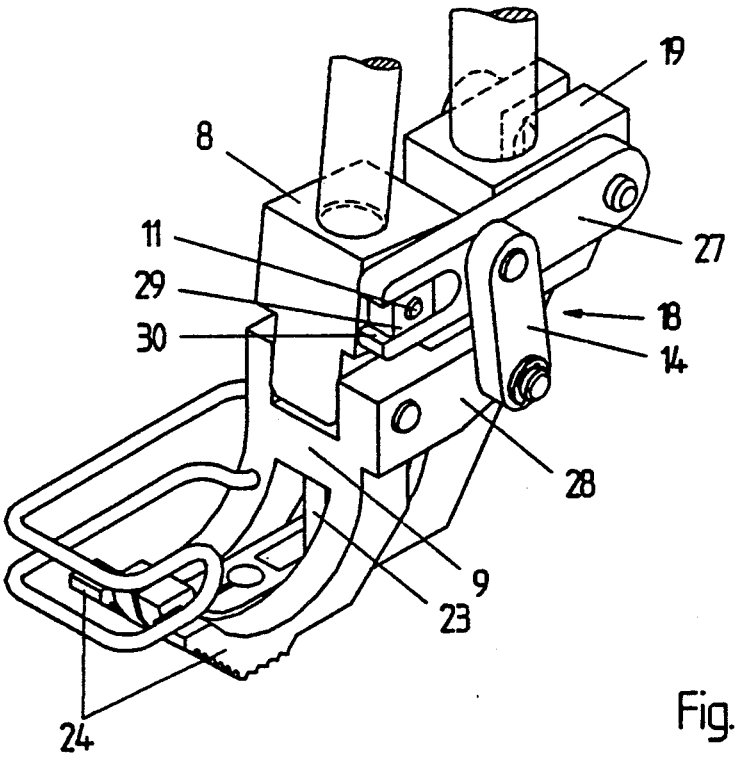
FIG. 6 is a perspective view of a presser device according to a second embodiment of the invention, having a holding foot with a link mounted on a block.

Another embodiment is shown in FIG. 6. Here the link transmission 18 includes a first link 27 which is swingably mounted on the block 19, a second link 28 which is swingably mounted on the block 8, a coupling 14 which is pivotally connected to both links 27, 28, and a slide block 29 which is mounted rotatably on the pivot pin 11 which is provided in the block 8 and protrudes from it. The slide block 29 is received in a slot 30 which, as shown in FIG. 6, is provided on the free end of the link 27.

Figure 3:
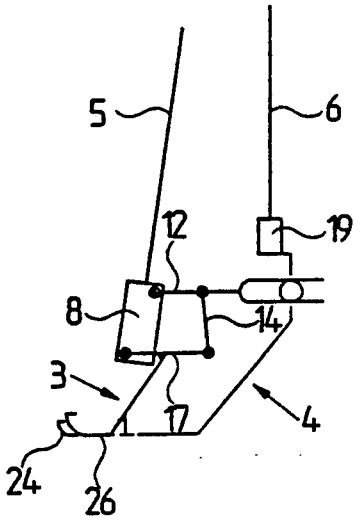
FIG. 3 is a diagrammatic showing of the presser device at the start of the feed phase of the feeder foot.

The manner of operation of the disclosed presser device will now be described:

As shown in FIGS. 2 and 3, at the start of the feed phase, the feeder foot 3 and the holding foot 4 are located briefly in their bottom position. The feeder bar 5 has reached its maximum clockwise oblique position and the front edges of the soles 24 are in the frontmost position, directed opposite to the direction of feed NV of the material. By suitable arrangement of the link transmission 18, it is assured that, in the aforementioned position, the axis of symmetry of the spur 23 is aligned vertically.

Figure 4:
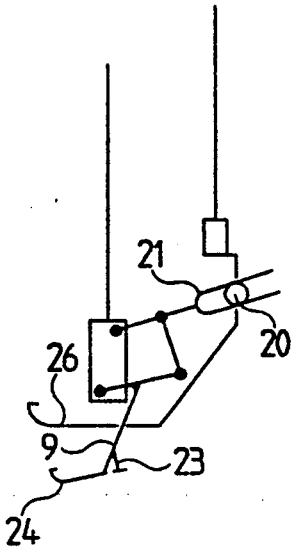
FIG. 4 is a diagrammatic showing of the presser device in the middle position of the feed phase of the feeder foot.

The start of the feed movement of the feeder foot 3, shown in FIG. 4, occurs when the feeder bar 5, starting from its maximum oblique position which has just been described, is swung in counterclockwise direction. At the same time, the holding bar 6, and with it the holding foot 4, move upwards. In this connection, the drive link 12 is swung in counterclockwise direction, with the result that, via the coupling 14, the driven link 17 and thus the sole part 9 are also swung in counterclockwise direction (compare FIG. 3 with FIG. 4). By swinging the sole part 9 in this way, a top layer of sewing material 31 is gripped by the aforementioned grip side of the soles 24 and, at the same time, the spur 23 is lifted off from the sewing material to a temporary oblique position (see FIG. 4). In this connection, a bottom layer 32 of sewing material is advanced by the cloth feeder 25 during the feed phase in a top-feed sewing machine 1 as shown in U.S. Pat. No. 3,196,815.

Since the spur 23 is brought into an inactive position at the very start of the feed phase, which position it retains in a greater or lesser oblique position (inclination) with respect to the vertical until the end of the feed phase, the spur 23 does not prevent the working-in of additional width of the upper layer 31 of material effected by the feeder foot 3.

Figure 5:
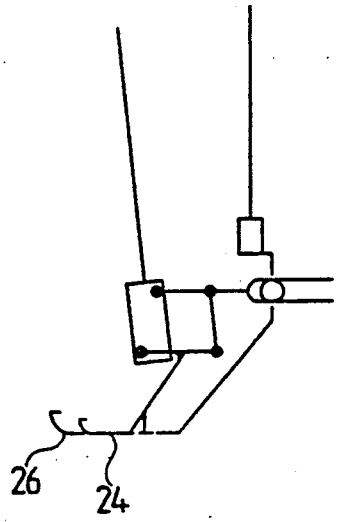
FIG. 5 is a diagrammatic showing of the presser device at the end of the feed phase of the feeder foot.

At the end of the feed phase, shown in FIG. 5, the feeder foot 3 and the holding foot 4 are again briefly in their low position, the feeder bar 5 then having reached its maximum counterclockwise oblique position as shown in FIG. 5 when the front edge of the soles 24 are in their rearmost position in the direction of feed NV of the material being sewn. In this position the axis of symmetry of the spur 23 is again directed vertically, i.e. it now presses again on the sewing material.

After the end of the feed phase, the alternating manner of operation of the feeder foot 3 and the holding foot 4 causes the feeder foot 3 to then be lifted off the sewing material, and then, by corresponding swinging of the feeder bar 5, the feeder foot 3 is moved opposite to the direction of feed NV of the sewing material, from the position in FIG. 5, back to its starting position in FIG. 3, for carrying out the next feed step. During the return movement of the feeder foot 3 which has just been described, the holding foot 4 is in its low position, as a result of which the layers of sewing material 31, 32 are held fast, free of displacement, between the bottom of the soles 26 and the top of the throat plate 22. By the lifting of the feeder foot 3 which has just been described, the spur 23 again assumes a corresponding oblique position which, however, is of no importance during the return movement of the feeder foot 3. When the feeder foot 3 has reached its starting position shown in FIG. 3, and the cloth feeder 25 has also returned to its starting position (FIG. 2) at this time, all measures have been taken to prepare for the start of the feed phase for the next following sewing stitch.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. In a top-feed sewing machine having a needle which is mounted for exclusively vertical reciprocating movement at a sewing point which is stationary with respect to a sewing material feed direction, a presser device which comprises a feeder foot supported by a vertically movable and swingably suspended feeder bar, and a holding foot which cooperates alternately with said feeder foot and is supported by a vertically movable holding bar, the feeder foot and holding foot each having a respective sole with a non-ski grip side arranged to engage material being sewn at the sewing point, the feeder foot furthermore having a spur which presses intermittently against the material being sewn, the improvement comprising transmission means interconnecting the feeder foot and the holding foot, for orienting the spur in a variable position with respect to the material, said position being a function of the position of the holding foot.

2. In a top-feed sewing machine having a presser device which comprises a feeder foot supported by a vertically movable and swingably suspended feeder bar, and a holding foot which cooperates alternately with said feeder foot and is supported by a vertically movable holding bar, the feeder foot and holding foot each having a respective sole with a non-skid grip side arranged to engage material begin sewn at a sewing point, the feeder foot furthermore having a spur which presses intermittently in a substantially vertical position against the material being sewn, the improvement comprising transmission means interconnecting the feeder foot and the holding foot, for orienting the spur in a variable position with respect to the material said position being a function of the position of the holding foot;

wherein the feeder foot and spur have an intermediate position in which the sole of he feeder foot engages a top portion of said material being sewn while the spur is out of engagement with the material being sewn.

3. The improvement according to claim 2, wherein the transmission means moves the spur through a range of angular positions with respect to said holding foot.

4. The improvement according to claim 2, wherein both said feeder foot sole and said spur engage said material being sewn in both an initial position and a final position of said feeder foot.

5. The improvement according to claim 2, wherein, in an initial position, said feeder bar is angled in a downstream direction with respect to said feed direction of a sewing material, and in said final position, said feeder bar is angled in an upstream direction with respect to said feed direction.

6. The improvement according to claim 2, wherein, in said initial position, said feeder foot is farther upstream with respect to said holding foot, than in said final position.

7. The improvement according to claim 4, wherein, in said initial position, said feeder foot is farther upstream with respect to said holding foot, than in said final position.

8. The improvement according to claim 3, wherein both said feeder foot sole and said spur engage said material being sewn in both an initial position and final position of said feeder foot.

9. In a top-feed sewing machine having a presser device which comprises a feeder foot supported by a vertically movable and swingably suspended feeder bar, and a holding foot which cooperates alternately with said feeder foot and is supported by a vertically movable holding bar, the feeder foot and holding foot each having a respective sole with a non-skid grip side arranged to engage material being sewn at a sewing point, the feeder foot furthermore having a spur which presses intermittently in a substantially vertical position against the material being sewn, the improvement comprising transmission means interconnecting the feeder foot and the holding foot, for orienting the spur in a variable position with respect to the material, said position being a function o the position of the holding foot;

wherein the feeder foot comprises an upper part attached to said feeder bar, and a lower sole part having said sole thereon, said sole part being pivotally connected to said upper part.

10. In a top-feed swing machine having a presser device which comprises a feeder foot supported by a vertically movable and swingably suspended feeder bar, and a holding foot which cooperates alternately with said feeder foot and is supported by a vertically movable holding bar, the feeder foot and holding foot each having a respective sole with a non-skid grip side arranged to engage material being sewn at a sewing point, the feeder foot furthermore having a spur which presses intermittently in a substantially vertical position against the material being sewn, the improvement comprising transmission means interconnecting the feeder foot and the holding foot, for orienting the spur in a variable position with respect to the material, said position being a function of the position of the holding foot;

wherein the transmission means includes a drive link, a driven link and a coupling, the drive link and the driven link being pivotally secured to the feeder bar and being connected to each other by the coupling, the feeder foot being pivotally secured to said driven link, and a free ned of the drive link having a slot which is slidably linked to one of the holding foot or the feed foot.

11. The improvement according to claim 10, wherein the feeder foot comprises an upper part attached to said feeder bar, and a lower sole part having said sole thereon, said sole part being pivotally connected to said upper part, wherein said driven link is at an upper portion of the sole part, and the sole and the spur are provided on a lower portion of the sole part.

12. The improvement according to claim 11, wherein an upper portion of the sole part serves as said second link and the sole and the spur are provided on a lower portion of the sole part.

13. The improvement according to claim 10, wherein said slot surrounds a pivot member which is provided on the holding foot.

14. The improvement according to claim 10, wherein the feeder foot comprises an upper part attached to said feeder bar, and a lower sole part having said sole thereon, said sole part being pivotally connected to said upper part, and the driven link being pivotally mounted on the upper part of the feeder foot.

15. The improvement according to claim 10, wherein said slot surrounds a pivot member which is provided on the feeder foot.

16. In a top-feed sewing machine having a presser device which comprises a feeder foot supported by a vertically movable and swingably suspended feeder bar, and a holding foot which cooperates alternately with said feeder foot and is supported by a vertically movable holding bar, the feeder foot and holding foot each having a respective sole with a non-skid grip side arranged to engage material being sewn at a sewing point, the feeder foot furthermore having a spur which presses intermittently in a substantially vertical position against the material being sewn, the improvement comprising transmission means interconnecting the feeder foot and the holding foot, for orienting the spur in a variable position with respect to eh material, said position being a function of the position of the holding foot;

wherein the transmission means includes a first link which is pivotally connected with the holding foot, a second link which is pivotally connected to said feeder foot, and a coupling which connects the first and second links to each other, a free end of the first link having a guide slot which receives a slide member which is mounted on one of the holding foot or the feeder foot.

17. The improvement according to claim 16, wherein an upper portion of the sole part serves as said second link and the sole and the spur are provided on a lower portion of the sole part.

18. The improvement according to claim 16, wherein the feeder foot comprises an upper part attached to said feeder bar, and a lower sole part having said sole thereon said sole part being pivotally connected to said upper part, and ht slide member being mounted on the upper part of the holding foot.

19. A presser device for a top-feed sewing machine, the presser device comprising:

a feeder foot supported by a feeder bar, and a holding foot which cooperates alternately with said feeder foot and is supported by a holding bar;

the feeder foot and holding foot each having a respective sole arranged to engage material being sewn near a sewing point;

the feeder foot further more having a spur which presses intermittently against the material being sewn; and transmission means interconnecting the feeder foot and the holding foot, for controlling the orientation of the feeder foot with respect to the material;

wherein the feeder foot and spur have an intermediate position in which the sole of the feeder foot engages a top portion of said material being sewn while the spur is out of engagement with the material being sewn.

20. A presser device as in claim 19, wherein said spur presses against the material being sewn in a substantially vertical position.

21. A presser device as in claim 20, wherein the transmission means is for orienting the spur in a variable position with respect to the material being sewn, said position being a function of the position of the holding foot vertically above the material.

22. A presser device as in claim 19, wherein said feeder bar is suspended so as to be vertically movable and swingable upstream and downstream with respect to a feed direction of the material being sewn.

23. A presser device as in claim 22, wherein said holding bar is suspended so as to be vertically movable.

24. A presser device as in claim 19, wherein said soles of the feeder foot and holding foot have respective gripping sides arranged to engage said material being sewn.

* * * * *